US005464142A

United States Patent [19]

Mol et al.

[11] Patent Number: 5,464,142

[45] Date of Patent: Nov. 7, 1995

[54] WEB BURSTING MACHINE

[75] Inventors: Hans C. Mol, Wilton; James S. Ramsey, Shelton, both of Conn.

[73] Assignee: Pitney Bowes Inc., Stamford, Conn.

[21] Appl. No.: 176,176

[22] Filed: Jan. 3, 1994

[51] Int. Cl.[6] ..... B65H 35/10

[52] U.S. Cl. ..... 225/100; 225/93

[58] Field of Search ..... 225/100, 97

[56] References Cited

U.S. PATENT DOCUMENTS

| | | | |
|---|---|---|---|
| 2,800,180 | 7/1957 | Jensen | 225/4 |
| 4,284,221 | 8/1981 | Nagel et al. | 225/100 |
| 4,577,789 | 3/1987 | Hofmann et al. | 225/100 |
| 4,688,708 | 8/1987 | Irvine et al. | 225/100 |
| 4,697,726 | 10/1987 | Gaucher | 225/100 |
| 5,060,838 | 10/1991 | Gergely et al. | 225/100 |
| 5,104,104 | 4/1992 | Mol | 270/52.5 |
| 5,104,726 | 4/1992 | Nakamura et al. | 225/100 |
| 5,133,615 | 7/1992 | Saito et al. | 400/621 |
| 5,141,142 | 8/1992 | Ramsey | 225/4 |
| 5,209,809 | 5/1993 | Walter et al. | 156/539 |

*Primary Examiner*—Kenneth E. Peterson

*Attorney, Agent, or Firm*—Charles R. Malandra, Jr.; Melvin J. Scolnick

[57] ABSTRACT

A web bursting machine is disclosed in which a pair of webs of indefinite length having individual sheets thereon delineated by transverse lines of weakening in the webs are separated therefrom by applying a mementary tension in the webs while drawing the webs over bursting elements while the webs are traveling longitudinally. The webs are fed simultaneously and continuously, but with the sheets of one web offset by one half pitch or sheet length from the sheets of the other so that a sheet is burst from one web or the other with each half pitch of travel of the two webs together, thereby eliminating any down time which would otherwise result from feeding the webs intermittently and stopping one web while the other is being burst.

4 Claims, 4 Drawing Sheets

WEB BURSTING MACHINE

BACKGROUND OF THE INVENTION

The present invention relates generally to the field of web bursting machines which separate sheets from webs having transverse lines of weakening across the web, and more particularly to machines of this nature which burst two webs simultaneously to maximize the sheet production rate of these machines.

It has long been well known to print various types of business forms and documents as a continuous web on which the individual forms or documents are delineated by transverse lines of weakening across the web. Typically such forms and documents are subject to certain types of preliminary operations prior to end use, such as mailing, which requires that the forms and documents be separated from each other to prepare them for these operations, such as stacking, collating, folding and inserting. A variety of machines have been developed and are commercially available which perform these, as well as other, preliminary operations in a continuous stream to maximize the output of the complete forms or documents processing system.

In a typical single web bursting machine, the bursting operation is achieved with the use of two sets or pairs of feed rollers, separated by a bursting element, usually in the form of a ball or cone. The upstream pair of rollers rotates at a predetermined speed to feed the web linearly at a predetermined speed along a guide mechanism toward the burst cone and then into the nip of the downstream pair of rollers which rotates at a higher speed than the upstream pair or at the same speed until the moment of burst, depending on the type of operation of the bursting machine. In one mode of operation, the downstream pair of rollers rotate continuously at a higher speed than the upstream pair rollers to maintain sufficient constant tension on the web to burst a sheet from the web at the instant that the transverse line of weakening is over the burst cone or ball. This mode of operation is not frequently used because the constant tension on the web tends to cause the web to burst prematurely or tear between the lines of weakening, which could be prevented to some degree by providing a relatively long distance between the upstream pair of rollers and the downstream pair of rollers, but this in turn tended to make the bursting machine inordinately large. Thus, bursting machines operating in this mode are not commercially popular. In the other mode of operation, both pairs of feed rollers operate at the same speed, but the downstream feed rollers are momentarily accelerated at the instant that the transverse line of weakening is over the burst cone to thereby apply sufficient tension to separate the sheet from the web. In still another mode of operation, again both pairs of feed rollers operate at the same speed, but the upstream feed rollers are momentarily decelerated or even stopped at the instant that the transverse line of weakening is over the burst cone, to thereby apply the same tension to the sheet to separate it from the web.

While this arrangement in any of these modes of operation worked very well in the variety of bursting machines then available, a significant drawback of these machines was that there is a limit to the speed at which these machines can operate due to certain practical considerations which is considerably below the rate at which other component machines in the sheet processing system can perform the specific operations for which they are intended. For example, in a typical processing system, a web of forms, which may be billing statements for a large number of bank customers, is fed to a bursting machine which separates the individual sheets of the statement of each customer from the web and feeds these sheets to a stacker, which stacks the proper number of sheets for the statement of each customer as determined by a suitable code printed on the sheets and which is read in or near the bursting machine. The stacked sheets are fed along a conveyer past a collating unit which inserts various types of materials, such as advertising flyers, etc., into the stack of forms, after which the stack is fed to a folding machine where the stack is folded to fit the mailing envelope into which the folded stack is inserted by an inserting machine. The filled envelope is then fed to a sealing machine which closes the envelope flap and seals it, after which it is fed to a mailing machine which prints a postage indicia thereon and finally stacks the envelope for mailing. A single machine which performs all of these functions sequentially is typically very large, e.g., 15 to 20 feet in length, is highly complex in construction with very sophisticated controls, and accordingly is normally very costly, often exceeding a hundred thousand dollars It is therefore important from a business profitability standpoint that machines of this nature operate at maximum efficiency.

As indicated above, one problem with single web bursters is that they cannot produce individual sheets from the web at the rate at which the component machines in the system can process the sheets. The major problem is that it is critical that the momentary tension that is applied to the web to cause a sheet to separate properly be applied at the exact instant that the transverse line of weakening in the web is directly adjacent to the burst ball or cone across which the web is drawn. There is a practical limit to the degree with which this can be controlled which is imposed by the nature of the devices used to effect this momentary tension. Traditional clutches, brakes and accelerating devices were quite slow. Present day stepping and brushless direct current motors provide much more accurate control and permit considerably higher operating speeds than was heretofore possible, but still cannot supply individual sheets at the rate at which the component machines in the system can handle them.

One solution known in the art has been to provide two webs which are fed through the bursting machine simultaneously, but with the sheets of one web offset longitudinally by one half pitch or sheet length from the other web, and from which sheets are separated alternately in either one of two modes of operation, either a single sheet from each web alternately, or a plurality of sheets successively from each web alternately. Obviously this arrangement greatly increased the efficiency and throughput rate of bursting machines, but introduced other problems, such as creep of one web with respect to the other, which resulted in misalignment of the two webs, thereby necessitating the use of two separate feeding and bursting components, one for each web. This in turn considerably increased the complexity and cost of the bursting machines, resulting in a further effort to obtain still greater efficiency and sheet throughput than was theretofore possible.

The major factor that limits the speed of operation of a dual web, dual burst mechanism machine, is that the webs are not fed through the machine at a constant velocity. Regardless of which mode of operation is utilized, i.e., single or plural sheets alternately, while one web is being advanced a sheet length to bring a transverse line of weakening to the burst cone, the other web is stationary. Thus, in the single sheet, alternate burst mode of operation, each web is stationary for the length of time required to move the other web one sheet length. In the plural sheet, alternate burst mode, each web is stationary for the length of time required to move the other web the length of the number of successive sheets to be burst from that web. Thus, for each bursting operation on one web, there is a certain amount of "down time" of the other web, which, in the totality of a particular web bursting and sheet processing operation, can accumulate sufficiently to amount to a very substantial loss of operating efficiency with resulting loss of profitability of the entire sheet processing system.

BRIEF SUMMARY OF THE INVENTION

The foregoing problems and disadvantages of the prior art machines are largely alleviated if not altogether eliminated by the present invention in which the efficiency and throughput rate of bursting machines embodying the present invention are greatly increased by maintaining both webs in continuous motion during the bursting operation, thereby eliminating the down time normally encountered with the intermittent web feed arrangements of the prior art machines. Thus, the present invention provides a still further mode of operation of essentially the same structural arrangement as in the prior art machines, under which both webs are maintained in continuous motion during the feeding and bursting operations, i.e., neither web moves with intermittent motion, with the result that there is no down time of either web while the other is being fed and burst.

In its broader aspects, the invention resides in a web bursting machine for separating individual sheets of material from a pair of spaced apart traveling webs of indefinite length on which the sheets are delaminated by successive spaced apart transverse lines of weakening. The invention comprises means defining first and second spaced apart, substantially parallel feed paths which converge at a downstream location to form a common feed path. There is a means in each feed path for feeding a web of indefinite length along each feed path with the transverse lines of weakening of each web disposed one half pitch offset from the other. There are first and second pairs of adjacent feed rollers disposed in the first and second feed paths respectively, being located adjacent the downstream ends of the feed paths, for continuously feeding both webs past the downstream ends of the feed paths. There are also first and second bursting means disposed in the first and second feed paths respectively adjacent to the first and second pairs of feed rollers on the downstream side thereof. A third pair of feed rollers is disposed at the juncture of the first and second feed paths and the common feed path for feeding individual sheets which have been separated from the webs along the common feed path. Finally, there is a control means for momentarily altering the relative linear feeding velocity between the third pair of feed rollers and the first and second pairs of feed rollers alternately when a transverse line of weakening of the first and second web is over the first and second bursting means respectively, whereby bursting tension is applied to the first and second webs alternately when the transverse lines of weakening of the second and first webs respectively are adjacent the bursting means so as to successively separate individual sheets from the webs as they move continuously through the bursting machine.

In some of its more limited aspects, the control means comprises a means for alternately momentarily accelerating or decelerating the rotational velocity of the first and third pairs of feed rollers, or the second and third pairs of feed rollers, depending on whether the change in relative linear feeding velocity is by acceleration or deceleration, when a transverse line of weakening of the web being burst is adjacent the bursting means, but maintaining constant the rotational velocity of the second and third pairs of feed rollers, or the first and third pairs of feed rollers, respectively, with the result that while the two webs move simultaneously one half pitch apart, only the web that has the transverse line of weakening over the burst cone has bursting tension applied thereto. Preferably, the acceleration and deceleration of the respective pairs of feed rollers is controlled by individual stepping motors for each pair of feed rollers under the control of a microprocessor which controls the timing of the acceleration or deceleration, as the case may be, in accordance with the location of the web in the feed mechanisms, which is determined by suitable position sensing devices which generate signals indicative of web movement and which transmit this information to the microprocessor.

Having briefly described the general nature of the present invention, it is a principal object thereof to provide a web bursting machine having greatly increased efficiency and sheet throughput compared to similar prior art bursting machines.

Another object of the present invention is to provide a web bursting machine in which two webs are maintained continuously in motion during the feeding and bursting operations to virtually eliminate the down time normally encountered with bursting machine which feed the webs intermittently.

A further object of the present invention is to provide a web bursting machine in which the construction and operation of the machine is no more complex or cumbersome than with similar prior art machines, but yet which operate with greatly increased efficiency and hence profitability.

These and other objects, advantages and desirable features of the present invention will become more apparent from an understanding of the following detailed description of two presently preferred embodiments of the invention, when considered in conjunction with the accompanying drawings.

DETAILED DESCRIPTION OF THE PREFERRED EMBODIMENTS

Figure 1:
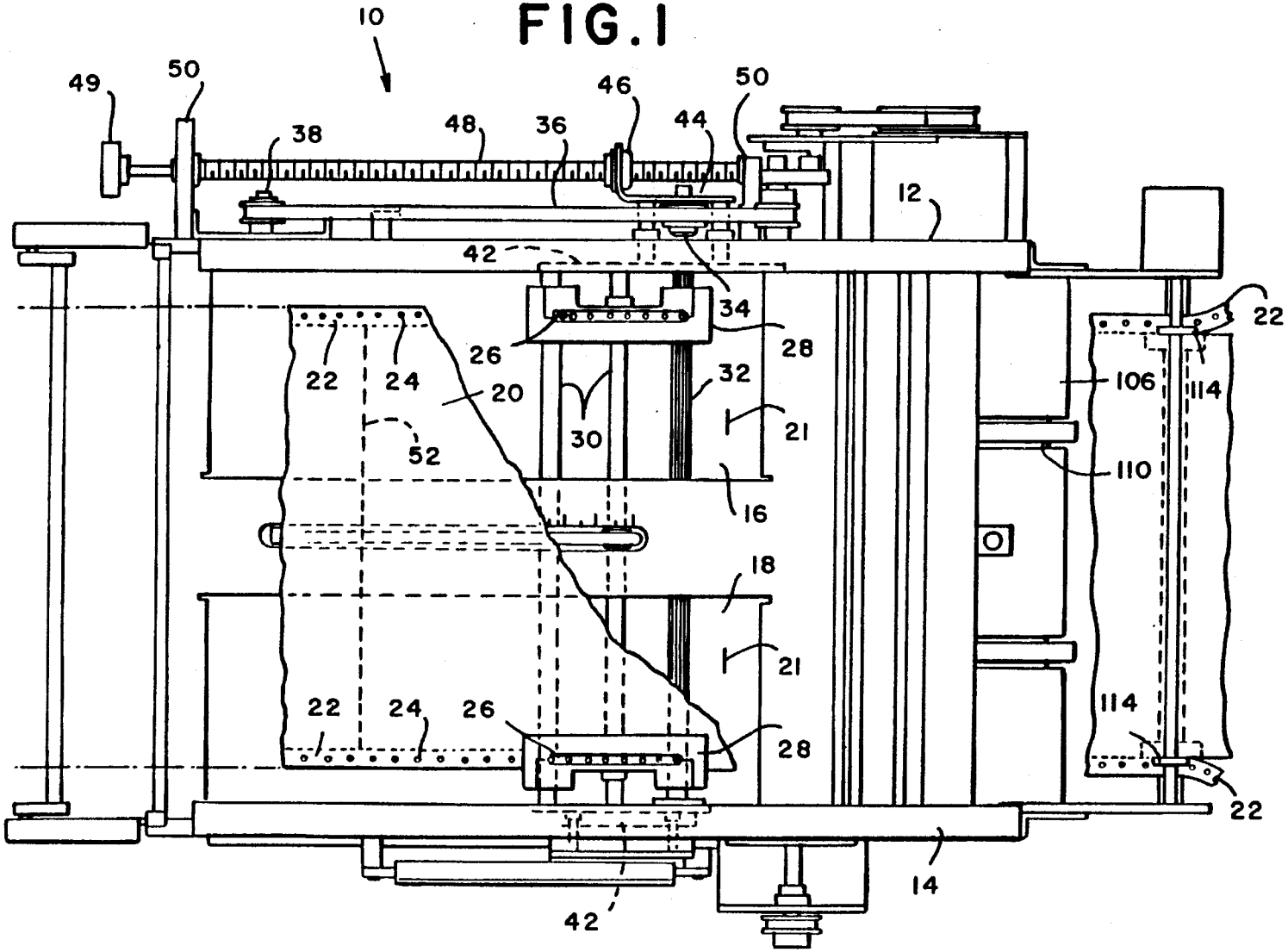
FIG. 1 is a plan view of a bursting machine embodying the present invention.

Referring now to the drawings, and particularly to FIG. 1 thereof, the bursting machine of the present invention, designated generally by the reference numeral 10, comprises a pair of longitudinally extending frame members 12 and 14 which are the major structural members forming a frame that supports all of the parts and components of the machine 10 yet to be described. A pair of horizontally oriented plates 16 and 18 are suitably mounted on the frame members 12 and 14 so as to support a web 20 adapted to be fed through the machine 10, the plates 16 and 18 defining a feed path for the web 20. Any suitable from of index marks are placed on the plates 16 and 18 to identify a predetermined location for aligning the lead edge of the web 20 as part of the initial setup procedure of the bursting machine fully described below. The web has a border portion 22 having pin holes 24 running along opposite longitudinal edges of the web 20. A pair of pin feeders 26 are mounted in frames 28 which are supported by spaced apart rods 30 supported by the frame members 12 and 14, and another splined rod 32 is also supported by the frame members 12 and 14 and extends through the pin feeders 26 to drive them in a direction to feed the web 20 from left to right as viewed in FIG. 1. The splined rod 32 is suitably driven by a pulley 34 which is engaged by a belt 36 which is driven by another motor driven pulley 38.

The distance between the pin feeders 26 and a lead edge sensing device 40, the purpose of which is fully explained below, can be adjusted to permit the bursting machine to accommodate webs having sheets of different length. As best seen in FIG. 1, the rods 30 are mounted in a pair of blocks 42 which are slidably supported by the frame members 12 and 14 so that the pin feeders 26 can be moved longitudinally along the feed path. This is accomplished by connecting the splined rod 32 to a slidable bracket 44 having a threaded nut 46 mounted on a correspondingly threaded rod 48, the rod 48 being journaled for rotation in mounts 50 attached to the frame member 12. Thus, by turning the rod 48 by means of the thumbwheel 49 in one direction or the other, the slidable bracket 44 is moved longitudinally, thereby moving the splined rod 32 and the pin feeder frames 28 in the same direction. Although not shown, the apparatus is provided with a suitable sheet length gauge, typically a fixed scale having numerical increments thereon and a pointer connected to a movable part connected to the bracket 44 so that the location of the pin feeders can be determined with respect to the bursting mechanism yet to be described.

The individual sheets on the web 20 are delineated by transverse lines of weakening 52, such as by scoring, perforating, etc., so that if sufficient tension in placed on the first sheet of the web, the sheet will separate or burst from the web along the transverse line of weakening, as is well known in the art.

Figure 3:
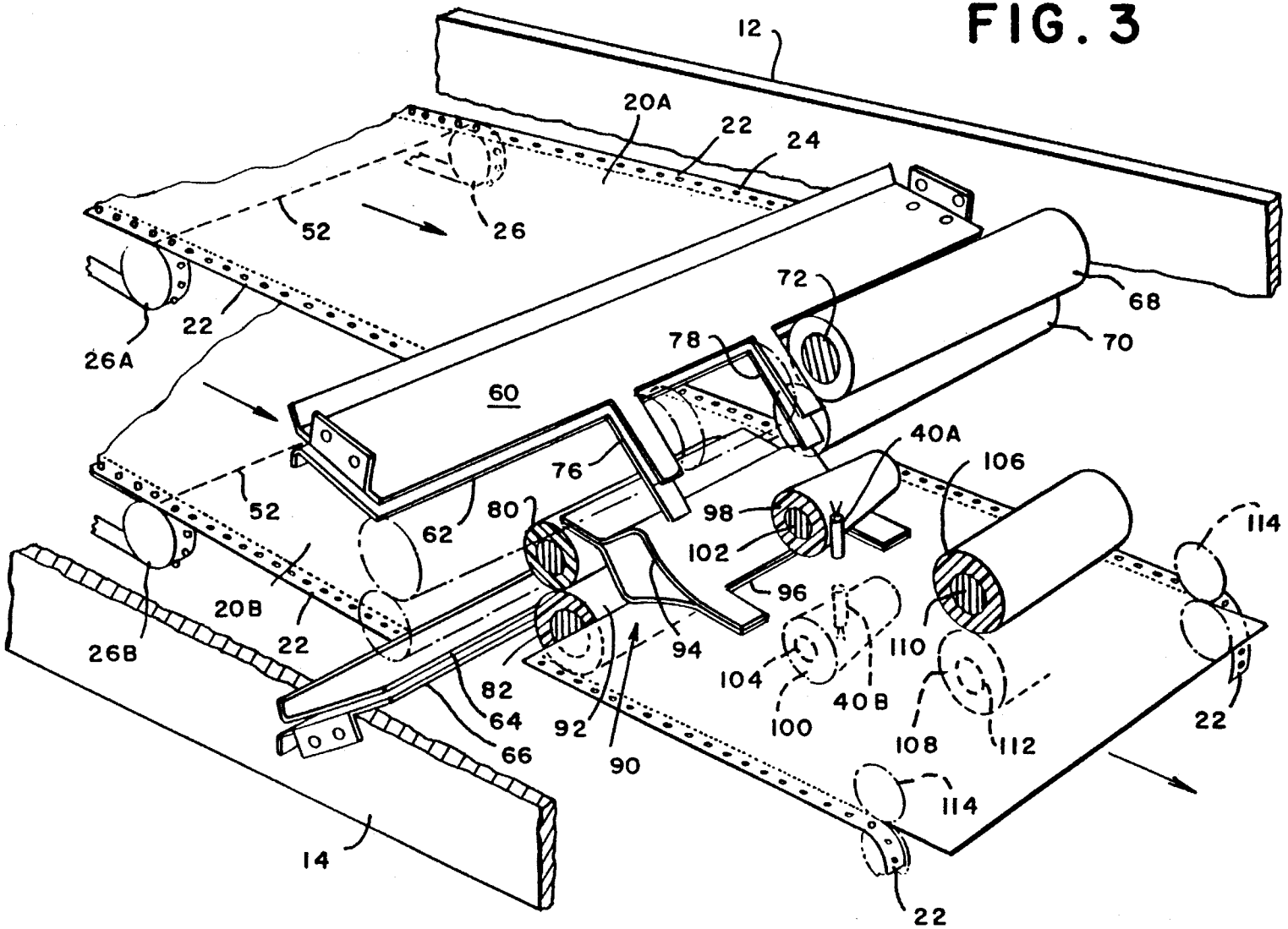
FIG. 3 is a perspective view of the bursting machine shown in FIGS. 1 and 2, with certain parts broken away or shown in section for clarity.

With reference to FIG. 3, it is seen that there are two webs 20, an upper web designed 20A and a lower web designed 20B. It will therefore be understood that all of the structure thus far described for the upper web 20A that is visible in FIG. 1 is duplicated for the lower web 20B, notwithstanding that this duplicate structure is not shown, so that there is both a separate feed path and a separate feeding means for each web. Parts already described in connection with FIG. 1 that appear in duplicate in order views are also designated with the suffix letter "A" for the upper path and "B" for the lower path.

Figure 2:
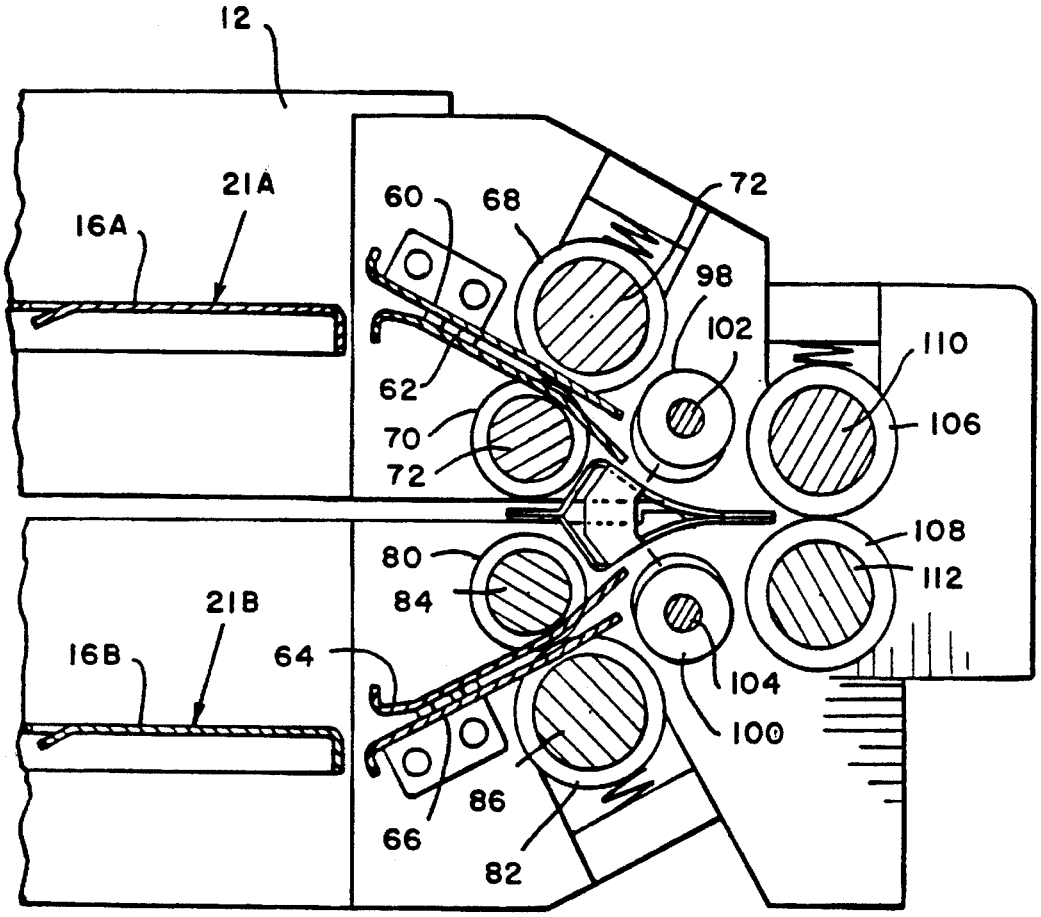
FIG. 2 is a side sectional view of the bursting machine shown in FIG. 1 taken on the line 2—2 of FIG. 1.

As best seen now in FIGS. 2 and 3, the upper and lower feed paths, designated by the upper horizontal support plate 16A and the lower horizontal support plate 16B respectively, both terminate in the downstream direction in a pair of upper spaced apart guide plates 60 and 62 and a pair of lower spaced apart guide plates 64 and 66 respectively, all of which are suitable supported by the frame members 12 and 14. These pairs of guide plates are angled toward each other in the downstream direction to as to cause the upper and lower feed paths to converge into one common feed path as hereinafter more fully described.

A first pair of upper feed rollers 68 and 70 are mounted on shafts 72 and 74 respectively which are journaled for rotation in the frame members 12 and 14 and are positioned adjacent to the downstream edges of the upper pair of guide plates 60 and 62. Although not clearly shown, the shafts 72 and 74 extend from one side of the machine 10 to the other, but the feed rollers 68 and 70 are segmented into three sections to accommodate the two sets of longitudinal extensions 76 and 78 formed on the upper pair of guide plates 60 and 62. A second pair of lower feed rollers 80 and 82 are mounted on shafts 84 and 86 respectively which are also journaled for rotation in the frame members 12 and 14 and are positioned adjacent to the downstream edges of the lower pair of guide plates 64 and 66. Again, though not clearly shown, the shafts 84 and 86 extend from one side of the machine 10 to the other, but the feed rollers 80 and 82 are segmented to accommodate the two sets of longitudinal extensions formed on the lower pair of guide plates 64 and 66.

Adjacent to the downstream side of the upper and lower pairs of feed rollers just described is a laterally elongate guide member designated generally by the reference numeral 90 which, as best seen in FIG. 3, defines a juncture of the upper and lower feed paths into a common feed path. The guide member 90 is suitably mounted between the frame members 12 and 14 and has upper and lower bulged portions 92 and 94 which cooperate with the upper and lower pairs of guide plates 60–62 and 64–66 respectively to form the terminal portions of the upper and lower feed paths, and to define the juncture of these feed paths with the common feed path at the downstream edge 96 of the guide member 90.

As seen in FIGS. 2 and 3, an upper and lower burst cone 98 and 100 are mounted on shafts 102 and 104 respectively which are supported by the frame members 12 and 14. It should be understood that the burst cones shown are merely illustrative of a variety of shapes which are suitable for the purpose of initiating a tear between the end sheet of the web and the next adjacent sheet when tension is applied to the end sheet while the transverse line of weakening between the two sheets is pressed against the burst cones, as further described below.

Next adjacent to the burst cones 98 and 100 is a third pair of feed rollers 106 and 108, often referred to as the burst rollers, which are mounted on shafts 110 and 112 respectively which extend between the frame members 12 and 14 and are journaled for rotation therein. It can now be seen that the outer periphery of the burst cones 98 and 100 intersect a line drawn between the nip of the burst rollers 98 and 100 and the nip of the upper and lower pairs of feed rollers 68–70 and 72–74 respectively, so that when tension is applied to that portion of a sheet between these sets of feed rollers, the sheet is pressed firmly against the outer periphery of the feed cones 98 and 100.

Downstream of the burst rollers 98 and 100 are a pair of motor driven strip trimmers 110 for removing the web border portions 22 with the pin holes 24.

Figure 4:
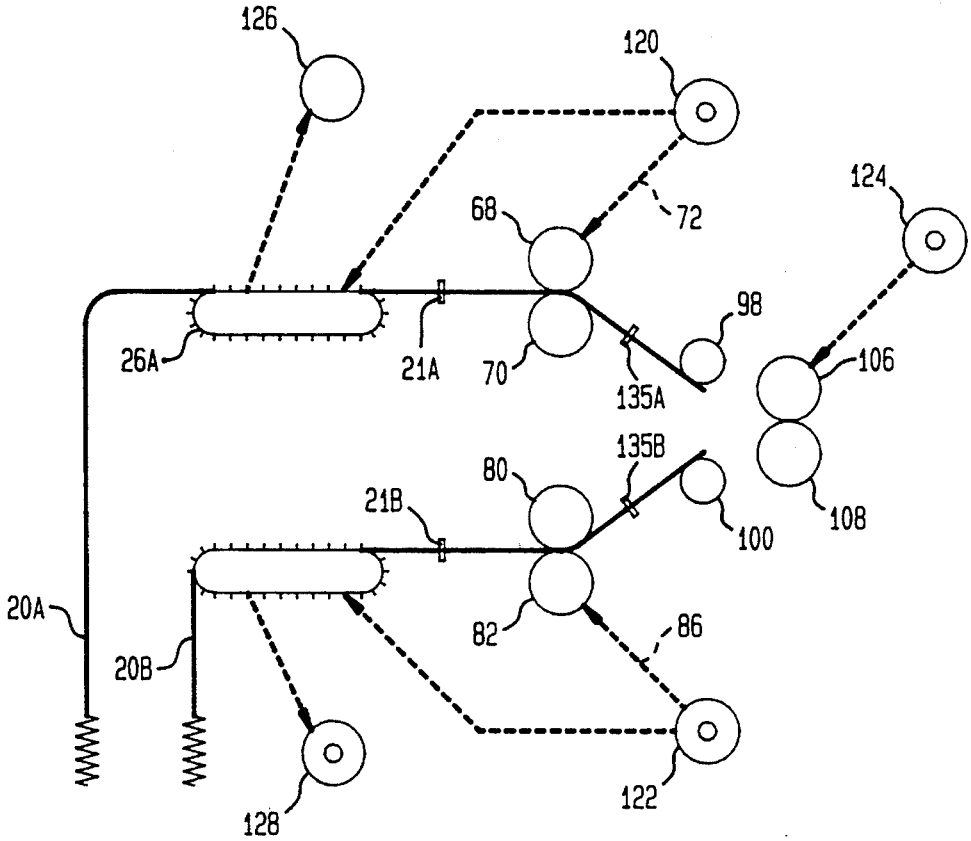
FIG. 4 is block diagram of the mechanical web drive and bursting elements, the stepper motors for driving the drive elements, and the encoder elements for controlling the timing of the operation of the stepper motors.

Referring now to FIG. 4, there is seen the major drive elements for the mechanical web drive and bursting elements, the stepper motors for driving the drive elements, and the encoder elements for initially setting the timing of the operation of the stepper motors and for continuously monitoring the position of the web. In the interest of brevity and simplicity only so much of the bursting machine 10 is shown as is necessary for a complete understanding of the invention. Thus, a first stepper motor 120 is suitably connected to the shaft 72 of the upper feed roller 68 of the upper feed roller pair to drive the feed roller 68 in a counter clockwise direction. This motor 120 is also suitably connected to the upper pin feeder 26A to drive the pin feeder 26A in synchronism with the feed rollers 68 and 70 until the lead edge of the web is engaged by the nip of these rollers, after which the pin feeders 26A are disengaged from the drive of the motor 120 through a suitable overriding slip clutch, as is well known in the art, because the feed rollers 68 and 70 feed the web 20A at a slightly higher speed than does the pin feeders 26A.

Similarly, another stepper motor 122 is suitably connected to the shaft 86 of the lower feed roller 82 of the lower feed roller pair to drive the roller 82 in a clockwise direction. This motor 122 is also suitably connected to the lower pin feeder 26B to drive the pin feeder 26B in synchronism with the feed rollers 82 and 80 until the lead edge of the web is engaged by the nip of these rollers, after which these pin feeders 26B are also disengaged from the drive of the motor 122 through the same arrangement as with the upper pin feeder 26A and for the same purpose.

A third stepper motor 124 is suitably connected to either the shaft 110 or 112 of the upper feed roller 106 or lower feed roller 108 respectively, since it is not important from the standpoint of the invention which of these rollers is driven.

A pair of suitable encoding devices 126 and 128, such as pulse counters, are suitably connected to the pin feeders 26A and 26B respectively to be driven thereby and are connected to a microprocessor described below in order to monitor the precise position of the webs 20A and 20B at all times during the operation of the bursting machine.

Figure 5:
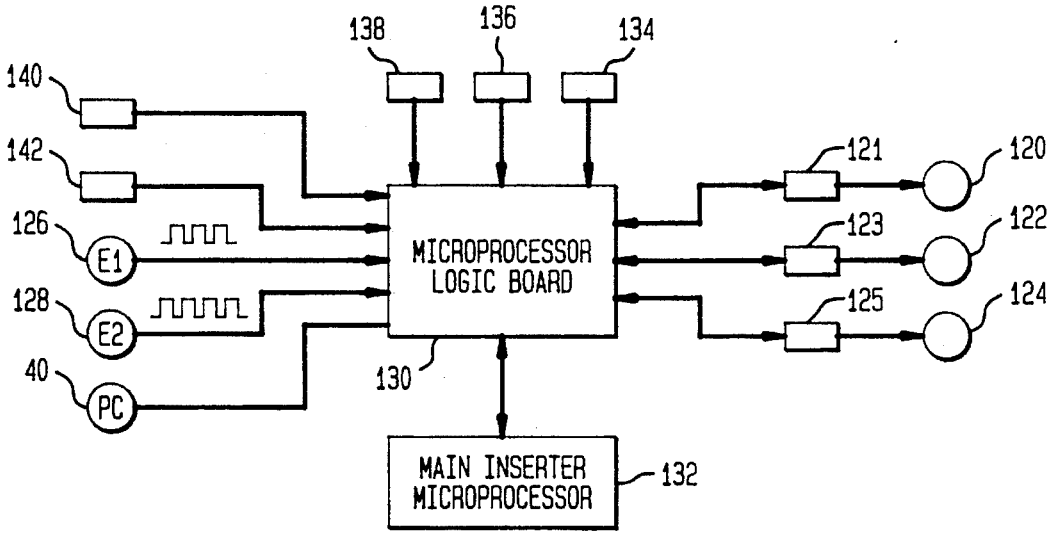
FIG. 5 is a block diagram of the basic logic of the total mechanical and electronic control elements of the bursting machine.

Referring now to FIG. 5, which shows the basic logic of the control package of the bursting machine, a microprocessor logic board 130 is suitably connected to the microprocessor 132 of the main inserter, of which the bursting machine 10 is a component machine, so that the bursting machine 10 will respond appropriately to certain commands from the inserter, such as stopping the bursting machine 10 in the event of a paper jam in the inserter. A suitable start/stop control 134 is provided for initially starting the bursting machine 10 to advance the webs 20 and 20B simultaneously to move the lead edges thereof from the index points 21A and 21B to a pair of reference points 135A and 135B. These reference points are merely locations adjacent to the upper and lower burst cones 98–100, which are fixed respect to the upper and lower feed roller pairs and the upper and lower burst cones, the purpose of which will become more apparent from the description of the operation of the bursting machine hereinbelow. A pair of upper and lower jog buttons 136 and 138 are provided for momentarily energizing the upper and lower stepper motors 120 and 122 to drive the upper and lower pin feeders 26A and 26B intermittently so as to move the webs 20A and 20B in small increments to line up the leading edges of the webs 20A and 20B with the index points 21A and 21B.

In order to permit the bursting machine 10 to accommodate webs having different sheet lengths, a pair of upper and lower web preset thumbwheel controls 140 and 142 are provided which input to the microprocessor 130 in known manner a suitable digital electronic signal which is indicative of the length of the sheets on each web 20A and 20B for which the position of the pin feeders 26A and 26B have previously been previously set by the mechanical thumbwheels 49A and 49B.

As previously mentioned, a pair of suitable encoding devices 126 and 128, such as pulse counters, are suitably connected to the pin feeders 26A and 26B respectively to be driven thereby. These are shown connected to the microprocessor 130 in order to monitor the precise position of the webs 20A and 20B and to provide an input to the microprocessor 130 as to how far a web has traveled since the last bursting operation. The microprocessor has been programmed by the preset thumbwheel control 140 and 142 to know how many counts should be accumulated before triggering the stepper motors to cause a sheet to burst, again as further described below.

A complete cycle of operation of the web bursting machine 10 will now be described, including the steps necessary to set up the machine to burst sheets from both webs simultaneously. To effect the initial setup of the bursting machine 10, the thumb wheels 49 of each shaft 48 (only the upper shaft is shown) are turned to rotate the shafts 48 to move the upper and lower pin feeders 26A and. 26B longitudinally with respect to the frame members 12 and 14 so that the pin feeders are properly positioned for the length of the sheets on each web. Next, the upper and lower webs 20A and 20B are pulled from a supply thereof onto the upper and lower support plates 16 and 18 (only the upper plates are shown), and the pin holes 24 of both webs are engaged with the pin feeders 26A and 26B. The jog buttons 136 and 138 are then manipulated to energize momentarily the motors 120 and 122 so as to preposition the webs 20A and 20B appropriately. For example, the jog button 136 is pushed to energize the upper motor 120 to cause the upper pin feeder 26A to move the upper web 20A until the lead edge thereof is at the index point 21A. The jog button 128 is then pushed to energize the lower motor 122 to cause the lower pin feeder 26B to move the lower web 20B until the lead edge of this web is at the index point 21B.

At this point, the start/stop button is depressed to energize the motors 120 and 122 to drive the pin feeders 26A and 26B to move both webs simultaneously from left to right until the lead edges thereof arrive at the constant reference points 135A and 135B located adjacent to the upstream side of the burst cones, at which point the microprocessor 130 causes the motors 120 and 122 to stop the feeding of the webs.

The bursting machine 10 is now in a standby mode, and is waiting for a signal from the inserter microprocessor 132 that indicates that the other machine components in the system are ready to receive paper from the bursting machine 10.

When this signal is transmitted from the inserter microprocessor 132 to the bursting machine microprocessor 130, the microprocessor 130 energizes the motors 120 and 124 simultaneously to start rotation of the upper feed roller pair 68–70 and the burst roller pair 106–108, thereby feeding the upper web. The movement of the pin feeder 26A causes the pulse counter 126 to start sending signals to the microprocessor 130, and when the microprocessor 130 has determined that one half of a sheet length of the upper web 20A has been fed, it then energizes the motor 122 to start rotation to commence feeding of the lower web 20B, thereby resulting in both webs being fed simultaneously but one half pitch apart. The movement of the pin feeder 26B causes the pulse counter 128 to start sending signals to the microprocessor 130.

When the first transverse line of weakening of the upper web 20A reaches the upper burst cone 98, the microprocessor 130 will have counted the number of pulses from the pulse counter 126 that corresponds to the sheet length that was programmed into the microprocessor by the upper preset thumbwheel control 140. When that number of counts has been reached, the microprocessor activates either one or two of the three motors appropriately to cause the pairs of feed rollers connected to the activated motors to effect a change in the relative linear feeding velocity between the burst roller pair and the upper feed roller pair when the transverse line of weakening of the upper web 20A is adjacent to the upper burst cone 98 to thereby burst the lead sheet from the upper web 20A in one of two different modes of operation, which will be described separately.

In one mode of operation, the bursting tension on each web is obtained by momentarily accelerating the rotational velocity of the burst rollers 106 and 108 while simultaneously momentarily accelerating the feed roller pair for the web which is not to be burst and maintaining constant the rotational velocity of the feed roller pair for the web that is to be burst. Thus, after the count described in the preceeding paragraph has been reached, the microprocessor 130 causes the motor 124 to accelerate momentarily the burst rollers 106 and 108, and at the same time causes the motor 122 to accelerate the lower feed roller pair 80–82 by the same amount and for the same length of time, thereby momentarily accelerating the linear velocity of the lower web 20B. However, since the rotational velocity of the motor 120 and hence that of the upper feed roller pair 68–70 remains constant, the upper web 20A is placed under high tension for the moment that the motor 124 and the burst rollers 106 and 108 were accelerated. This momentary tension causes the lead sheet of the upper web 20A to burst from the web along the transverse line of weakening, as is well known in the art. The sheet is then carried away from the bursting machine 10, being passed through the pin hole border stripping mechanism 114, to be further processed in the system.

After both webs have traveled one half sheet length, the transverse line of weakening of the lower web 20B will be adjacent to the lower burst cone 100, and the microprocessor 130 will have counted the number of pulses from the lower pulse counter 128 that corresponds to the sheet length that was programmed into the microprocessor by the lower preset thumbwheel control 142. The microprocessor 130 then causes the motor 124 to accelerate the burst rollers 106 and 108 again, and at the same time causes the motor 120 and the upper feed roller pair 68–70 to accelerate by the same amount and for the same length of time, thereby momentarily accelerating the linear velocity of the upper web 20A. Now, however, since the rotational velocity of the motor 122 and hence that of the lower feed roller pair 80–82 remains constant, the lower web 20B is placed under high tension for the moment that the motor 124 and the burst rollers 106 and 108 are accelerated. Again, this momentary tension causes the lead sheet of the lower web 20B to burst from the web along the transverse line of weakening, and this sheet is then carried away for further processing.

The above cycle continues so long as both webs are fed continuously, with the microprocessor alternately accelerating the upper and lower feed roller pairs each time that the burst rollers are accelerated for each one half sheet length so that the bursting tension is applied to each web alternately each time the transverse line of weakening of each web respectively is adjacent to the appropriate burst cone.

In the other mode of operation, the burst rollers 106 and 108 are always run at the same rotational velocity, and the bursting tension on each web is obtained by momentarily decelerating the feed roller pair for that web. Thus, after the aforementioned count has again been reached (it will be understood that the counting process in the microprocessor is zeroed out and restarted with each bursting operation, as is standard in the art), the microprocessor 130 causes the motor 120 and 122 to momentarily decelerate the upper or lower feed roller pairs respectively, depending on whether it is the upper or lower web 20A and 20B respectively that has its transverse line of weakening adjacent to the upper or lower burst cone 98 or 100 respectively. When that feed roller pair is momentarily decelerated, the web associated with that feed roller pair is momentarily put under sufficient tension to cause the lead sheet to burst from the web. One significant advantage of this mode of operation over the other is that this mode permits the elimination of the microprocessor controls which are necessary to momentarily accelerate the burst rollers 106 and 108 since they are run at a uniform rotational velocity in this mode of operation.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

What is claimed is:

1. A web bursting machine for separating individual sheets of material from a pair of spaced apart traveling webs of indefinite length on which said sheets are delineated by successive spaced apart transverse lines of weakening, said machine comprising:

A. means defining first and second spaced apart, substantially parallel feed paths which converge at a downstream location to form a common feed path, B. means in said first and second feed paths for feeding a web of indefinite length along said feed paths with the transverse lines of weakening of each web disposed one half pitch offset from the other, C. first and second pairs of adjacent feed rollers disposed in said first and second feed paths respectively adjacent the downstream ends of said feed paths for continuously feeding both said webs past said downstream ends of said feed paths, D. first and second bursting means disposed in said first and second feed paths respectively adjacent said first and second pairs of feed rollers on the downstream side thereof, E. a third pair of feed rollers disposed at the juncture of said first and second feed paths and said common feed path for feeding individual sheets which have been separated from said webs along said common feed paths, and F. control means for momentarily altering the relative linear feeding velocity alternately between said third pair of feed rollers and said first and second pairs of feed rollers when a transverse line of weakening of said first and second web is over said first and second bursting means respectively, whereby bursting tension is applied to said first and second webs alternately when the transverse lines of weakening of said second and first webs respectively are adjacent said bursting means so as to successively separate individual sheets from said webs as said webs move continuously through the bursting machine, wherein said control means comprises means for alternately momentarily accelerating the rotational velocity of said first and third pairs of feed rollers when a transverse line of weakening of said second web is adjacent said second bursting means, but maintaining the rotational velocity of said second pair of feed rollers constant, and momentarily accelerating the rotational velocity of said second and third pairs of feed rollers when a transverse line of weakening of said first web is adjacent said first bursting means, but maintaining the rotational velocity of said first pair of feed rollers constant, whereby bursting tension is applied alternately to both said webs to separate individual sheets therefrom.

2. A bursting machine as set forth in claim 1 wherein said means for alternately accelerating said pairs of feed rollers comprises A. first, second and third stepping motors for driving said first, second and third pairs of feed rollers respectively, B. first and second signal generating means responsive to movement of the webs in said first and second feed paths respectively for generating signals indicative of the length of web that has been fed, and C. microprocessor means capable of counting the signals from said first and second signal generating means and responsive to reaching a predetermined count programmed in said microprocessor which is indicative of the length of a sheet on the webs for controlling the rotational velocity of said first, second and third stepping motors to momentarily accelerate said first and third stepping motors when said first web is being burst and to momentarily accelerate said second and third motors when said second web is being burst to obtain the required tension of the webs to cause the lead sheet of each web to burst therefrom.

3. A web bursting machine for separating individual sheets of material from a pair of spaced apart traveling webs of indefinite length on which said sheets are delineated by successive spaced apart transverse lines of weakening, said machine comprising:

A. means defining first and second spaced apart, substantially parallel feed paths which converge at a downstream location to form a common feed path, B. means in said first and second feed paths for feeding a web of indefinite length along said feed paths with the transverse lines of weakening of each web disposed one half pitch offset from the other, C. first and second pairs of adjacent feed rollers disposed in said first and second feed paths respectively adjacent the downstream ends of said feed paths for continuously feeding both said webs past said downstream ends of said feed paths, D. first and second bursting means disposed in said first and second feed paths respectively adjacent said first and second pairs of feed rollers on the downstream side thereof, E. a third pair of feed rollers disposed at the juncture of said first and second feed paths and said common feed path for feeding individual sheets which have been separated from said webs along said common feed paths, and F. control means for momentarily altering the relative linear feeding velocity alternately between said third pair of feed rollers and said first and second pairs of feed rollers when a transverse line of weakening of said first and second web is over said first and second bursting means respectively, whereby bursting tension is applied to said first and second webs alternately when the transverse lines of weakening of said second and first webs respectively are adjacent said bursting means so as to successively separate individual sheets from said webs as said webs move continuously through the bursting machine, wherein said control means comprises means for alternately momentarily decelerating the rotational velocity of said first pair of feed rollers when a transverse line of weakening of said first web is adjacent said first bursting means, but maintaining the rotational velocity of said second pair of feed rollers constant, and momentarily decelerating the rotational velocity of said second pair of feed rollers when a transverse line of weakening of said second web is adjacent said second bursting means, but maintaining the rotational velocity of said first pair of feed rollers constant, whereby bursting tension is applied alternately to both said webs to separate individual sheets therefrom.

4. A bursting machine as set forth in claim 3 wherein said means for alternately decelerating said pairs of feed rollers comprises A. first, second and third stepping motors for driving said first, second and third pairs of feed rollers respectively, B. first and second signal generating means responsive to movement of the webs in said first and second feed paths respectively for generating signals indicative of the length of web that has been fed, and C. microprocessor means capable of counting the signals from said first and second signal generating means and responsive to reaching a predetermined count programmed in said microprocessor which is indicative of the length of a sheet on the webs for controlling said first, second and third stepping motors to momentarily decelerate said first motor when said first web is being burst and to momentarily decelerate said second motor when said second web is being burst, and to maintain a constant speed for said third stepping motor when said first and second webs are being burst to obtain the required tension of the webs to cause the lead sheet of each web to burst therefrom.

* * * * *